US008806991B2

(12) United States Patent
Grand

(10) Patent No.: US 8,806,991 B2
(45) Date of Patent: Aug. 19, 2014

(54) MULTI-BIT TOOL HAVING SPRING LOADED ACTUATION MECHANISMS AND A RIGID STRUCTURAL FRAME

(76) Inventor: Gerard Grand, St. Catharines (CA)

( * ) Notice: Subject to any disclaimer, the term of this patent is extended or adjusted under 35 U.S.C. 154(b) by 383 days.

(21) Appl. No.: 12/647,532

(22) Filed: Dec. 27, 2009

(65) Prior Publication Data

US 2011/0214539 A1 Sep. 8, 2011

(51) Int. Cl.
*B25B 23/16* (2006.01)

(52) U.S. Cl.
USPC ..... 81/177.85; 81/439; 81/177.4

(58) Field of Classification Search
USPC ..... 81/439, 440, 177.4, 437, 490, 177.85, 81/52
See application file for complete search history.

(56) References Cited

U.S. PATENT DOCUMENTS

| | | | | | |
|---|---|---|---|---|---|
| 2,629,413 | A * | 2/1953 | Stettler | 81/490 |
| 2,854,745 | A * | 10/1958 | Braverman | 30/162 |
| 3,006,395 | A * | 10/1961 | Dye | 81/177.4 |
| 3,194,286 | A * | 7/1965 | Wagner | 81/439 |
| 3,750,729 | A * | 8/1973 | Lemieux | 81/439 |
| 4,327,790 | A * | 5/1982 | Stevens et al. | 81/177.4 |
| 4,480,668 | A * | 11/1984 | Lin | 81/439 |
| 4,924,733 | A * | 5/1990 | McKenzie | 81/438 |
| 5,325,745 | A * | 7/1994 | Koehler | 81/439 |
| 5,673,600 | A * | 10/1997 | Yanagi et al. | 81/490 |
| 6,205,893 | B1 * | 3/2001 | Sato | 81/439 |
| 6,237,451 | B1 * | 5/2001 | Wei | 81/490 |
| 6,332,384 | B1 * | 12/2001 | Cluthe | 81/490 |
| 6,971,291 | B2 * | 12/2005 | An | 81/177.2 |
| 7,188,555 | B2 * | 3/2007 | Beauchamp | 81/439 |
| 7,275,466 | B2 * | 10/2007 | Cluthe | 81/439 |
| 7,493,838 | B2 * | 2/2009 | Beauchamp | 81/177.4 |
| 7,562,606 | B2 * | 7/2009 | Grand et al. | 81/439 |
| 7,665,391 | B2 * | 2/2010 | Beauchamp | 81/177.4 |
| 7,938,045 | B2 * | 5/2011 | Itoh | 81/439 |
| 2002/0007705 | A1 * | 1/2002 | Beauchamp | 81/490 |

* cited by examiner

*Primary Examiner* — Robert Scruggs

(57) ABSTRACT

A multi-bit tool comprises a housing having a bit chuck with a bit-receiving opening. A substantially rigid main frame member defines a plurality of longitudinal channels and is disposed within the housing such that each of the plurality of longitudinal channels is generally aligned along the longitudinal axis of the multi-bit tool. A plurality of spring loaded actuator mechanisms are mounted in rigidly retained relation within one channel of the frame member. Each spring loaded actuator mechanism has a carriage member movable between a rearward position and a forward position, and a trigger member movable between a rest position, a forward triggering position and a rearward triggering position. The carriage member is moved to its rearward position by movement of the trigger member to its rearward triggering position and the carriage member is moved to its forward position by movement of the trigger member to its forward triggering position. Bit assemblies having a tool bit are operatively mounted within the housing for movement by the actuator mechanism between a retracted configuration and a forwardly extended in-use configuration corresponding. Each bit assembly is operatively connected to the carriage member on a corresponding spring loaded mechanism for co-operative movement therewith.

25 Claims, 18 Drawing Sheets

37S
39
32
39P
21

"D"

MULTI-BIT TOOL HAVING SPRING LOADED ACTUATION MECHANISMS AND A RIGID STRUCTURAL FRAME

FIELD OF THE INVENTION

The present invention relates to a multi-bit tool and also to a multi-bit apparatus in general, and more particularly to a multi-bit tool having spring loaded actuation mechanisms.

BACKGROUND OF THE INVENTION

Tools, such as multi-bit screwdrivers, that have a plurality of tool bits that are selectively usable one at a time, are well-known. In use, one tool bit is manually selected at a time via a sliding button to extend forwardly out of a housing through a bit chuck to an extended in-use configuration. An actuation mechanism causes the selected tool bit to move to its extended in-use configuration in response to the sliding button moving forwardly, and causes the selected tool bit to move back to its retracted configuration in response to the sliding button moving rearwardly.

It is even known to make the actuation mechanism automatic, through the inclusion of a spring arrangement, such that a small movement of an actuator button in a forward direction will cause the selected tool bit too moved to its extended in-use position, and a small movement of that same actuator button it at rearward direction will cause the extended tool bit to return to its retracted position.

The problem with this prior art multi-bit screwdriver is that a user must first retract the extended tool bit before extending another tool bit, which is a two-step process. Moreover, if the extended tool bit is not retracted before a second tool bit is extended, one or both of the actuator mechanisms of the extended or partially extended tool bits will jam.

It has been found that in one particular prior art multi-bit driver having cartridge type spring loaded actuation mechanisms, namely U.S. Pat. No. 7,275,466 issued Oct. 2, 2007 to Cluthe, the cartridge type spring loaded actuation mechanisms are all closely fit into an outer housing so as to be in abutting relation. In use, it is common for the working elements of the cartridge mechanisms to become jammed during use. In fact, such jamming is so common, that the manufacturer/distributor of the product supplies instructions on the packaging for un-jamming the actuation mechanisms, by tapping the bottom end of the screwdriver on a surface a few times to dislodge any stuck bits.

It is believed that in such multi-bit drivers wherein a plurality of spring loaded actuation mechanisms are used, it is common for the actuation mechanisms to move with respect to each other, thus permitting deviation of the form of the actuation mechanisms. Further, it is believed that the actuation mechanisms, which are made from plastic and in the form of an elongate rectangular prism, are readily distorted by pressure on the housing of the multi-bit driver, thus causing the working elements of the actuation mechanisms to jam.

While developing a multi-bit tool that has cartridge type spring loaded actuation mechanisms, it was found that operating the trigger mechanisms on the exterior of the housing to select tool bits, a user's thumb can readily become fatigued and sore. In an attempt to solve this problem, it was realized that a collar type selector mechanism has been included to provide a more ergonomic multi-bit tool. The collar type selector mechanism engages the actuator buttons of the cartridge type spring loaded actuation mechanisms. However, it was found that using a collar type selector mechanism caused some significant problems. With the cartridges disposed within the main body, in parallel relation one to another, it was found that the torque that is applied to the housing of the multi-bit tool caused the housing to deform in a slightly twisted configuration, in spite of the fact that the housing is designed to transmit significant torque from a user's hand to the bit being used. Such twisting of the housing causes the cartridges to each twist so that they are no longer straight. Further, it was found that the cartridges can also move with respect to each other. The result is that the path that the moving mechanism must travel is no longer straight and it readily becomes stuck. It should also be understood that when the cartridges move with respect to each other they also move with respect to the path that must be traveled, both by the mechanism and the tool bit itself, thus also making it mor probable that the tool bit assembly itself could become stuck.

One basic consideration in the design of a multi-bit tool or multi-bit apparatus having spring loaded actuation mechanisms is that the bit assemblies that are necessarily used have too many degrees of freedom to readily move within the housing of the multi-bit tool or multi-bit apparatus without sticking at least occasionally, and possibly frequently, unless certain improvements and/or considerations are made to ensure that a straight open path is presented for a bit assembly so that it does not face any obstructions or any more friction than necessary.

It has also been found during experimentation that merely increasing the strength of the springs of the actuator mechanism did not work. The actuator mechanism just became more sensitive during its overall operation and the movable carriage member that carries the bit assembly would bounce back.

It is an object of the present invention to provide a multi-bit tool having spring loaded actuation mechanisms.

It is another object of the present invention to provide a multi-bit tool having spring loaded actuation mechanisms, wherein the jamming of the tool bit assemblies and the spring loaded actuation mechanisms is significantly reduced, and perhaps almost eliminated.

It is a further object of the present invention to provide a multi-bit tool having spring loaded actuation mechanisms, which multi-bit tool is more ergonomic and therefore easier to use.

SUMMARY OF THE INVENTION

In accordance with one aspect of the present invention there is disclosed a novel multi-bit tool comprising a substantially annular housing having a central interior cavity and a bit chuck with a bit-receiving opening, and defining a longitudinal axis. A substantially rigid main frame member has a front end and a back end. The housing and the substantially rigid main frame member are structurally interconnected one to the other such that the substantially rigid main frame member precludes significant torsional deformation of the housing. A plurality of spring loaded actuator mechanisms are disposed within the interior cavity of the housing. Each spring loaded actuator mechanism has a carriage member movable between a rearward position and a forward position, and a trigger member movable between a rest position, a forward triggering position and a rearward triggering position. The carriage member is moved to its rearward position by movement of the trigger member to its rearward triggering position and the carriage member is moved to its forward position by movement of the trigger member to its forward triggering position. There is also a plurality of bit assemblies. Each bit assembly has a tool bit at a front end and is operatively mounted within the housing for movement by the actuator mechanism between a retracted configuration corresponding to the rearward position of the carriage member, and a forwardly extended in-use configuration corresponding to the forward position of the carriage member and whereat the bit assembly is positioned such that the tool bit extends outwardly from the housing through the opening of the bit chuck. Each bit assembly is operatively connected to the carriage member on a corresponding spring loaded mechanism for co-operative movement therewith. In use, as each carriage member moves between its rearward position and its forward position, the corresponding spring loaded actuator mechanism is retained substantially in its correct form by the substantially rigid main frame member.

In accordance with another aspect of the present invention there is disclosed a novel multi-bit tool comprising a substantially annular housing having a central interior cavity and a bit chuck with a bit-receiving opening, and defining a longitudinal axis. A substantially rigid main frame member has a front end and a back end. A plurality of spring loaded actuator mechanisms are carried in rigidly retained relation by the substantially rigid main frame member within the interior cavity of the housing. Each the spring loaded actuator mechanism has a carriage member movable between a rearward position and a forward position, and a trigger member movable between a rest position, a forward triggering position and a rearward triggering position. The carriage member is moved to its rearward position by movement of the trigger member to its rearward triggering position and the carriage member is moved to its forward position by movement of the trigger member to its forward triggering position. There is also a plurality of bit assemblies. Each bit assembly has a tool bit at a front end and is operatively mounted within the housing for movement by the actuator mechanism between a retracted configuration corresponding to the rearward position of the carriage member, and a forwardly extended in-use configuration corresponding to the forward position of the carriage member and whereat the bit assembly is positioned such that the tool bit extends outwardly from the housing through the opening of the bit chuck. Each bit assembly is operatively connected to the carriage member on a corresponding spring loaded mechanism for co-operative movement therewith. In use, as each carriage member moves between its rearward position and its forward position, the corresponding spring loaded actuator mechanism is retained substantially in its correct form by the substantially rigid main frame member.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the multi-bit tool according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
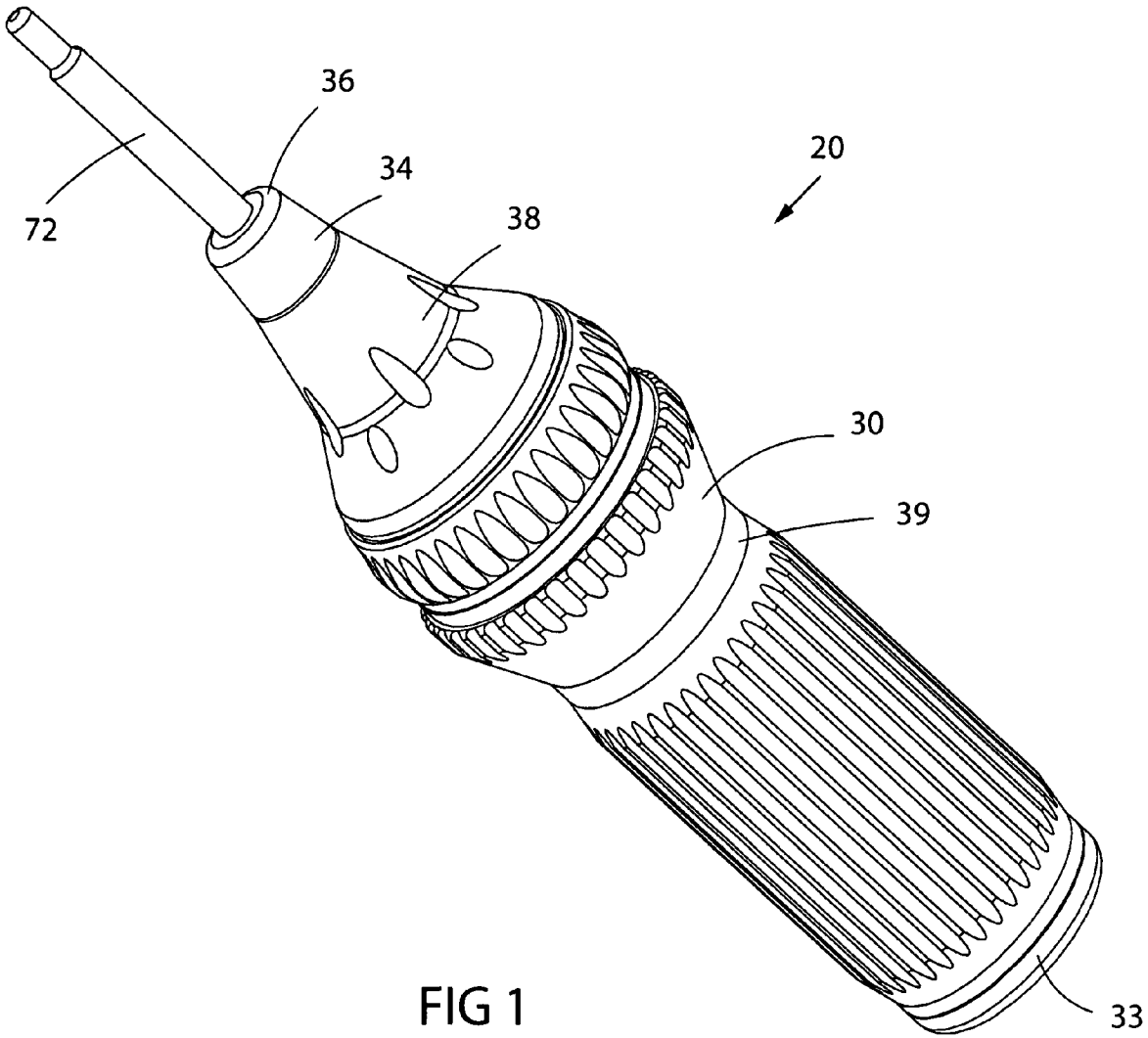
FIG. 1 is a perspective view from the front of the preferred embodiment of the multi-bit tool according to the present invention, with the tool bit extended.
Figure 2:
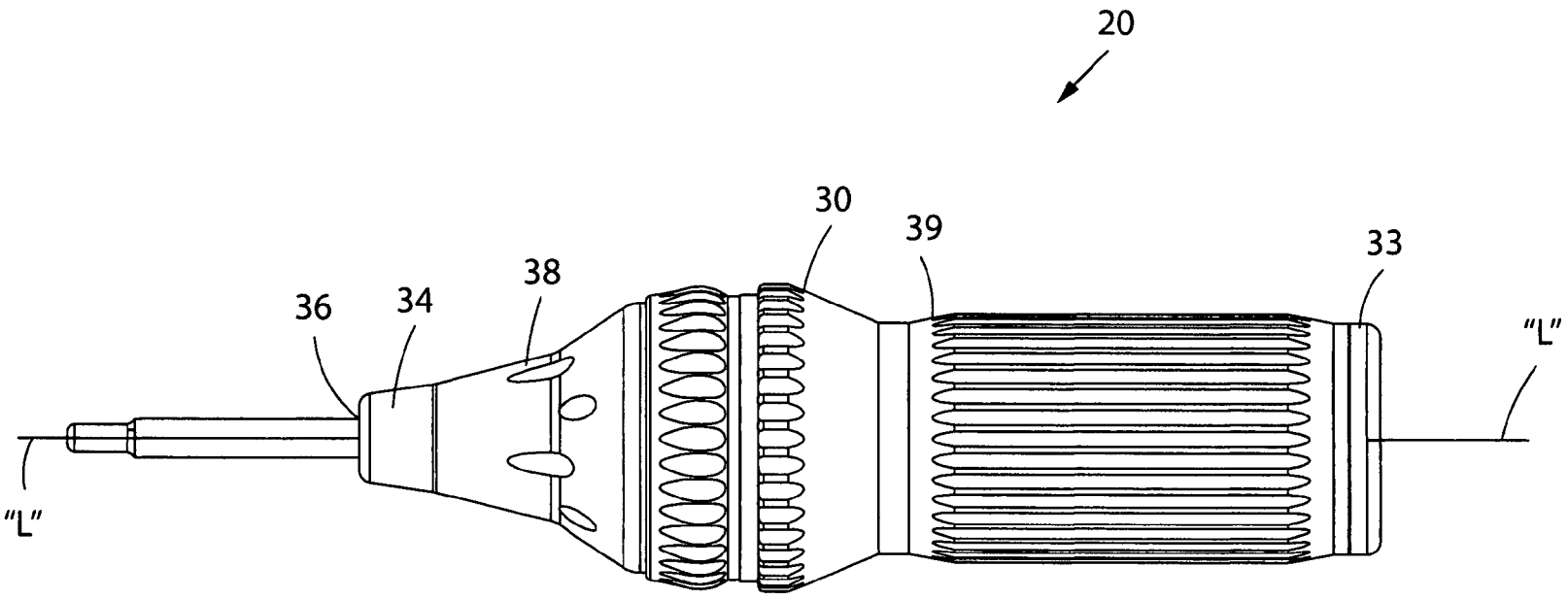
FIG. 2 is a side elevational view of the preferred embodiment of the multi-bit tool of FIG. 1, with the tool bit extended.
Figure 3:
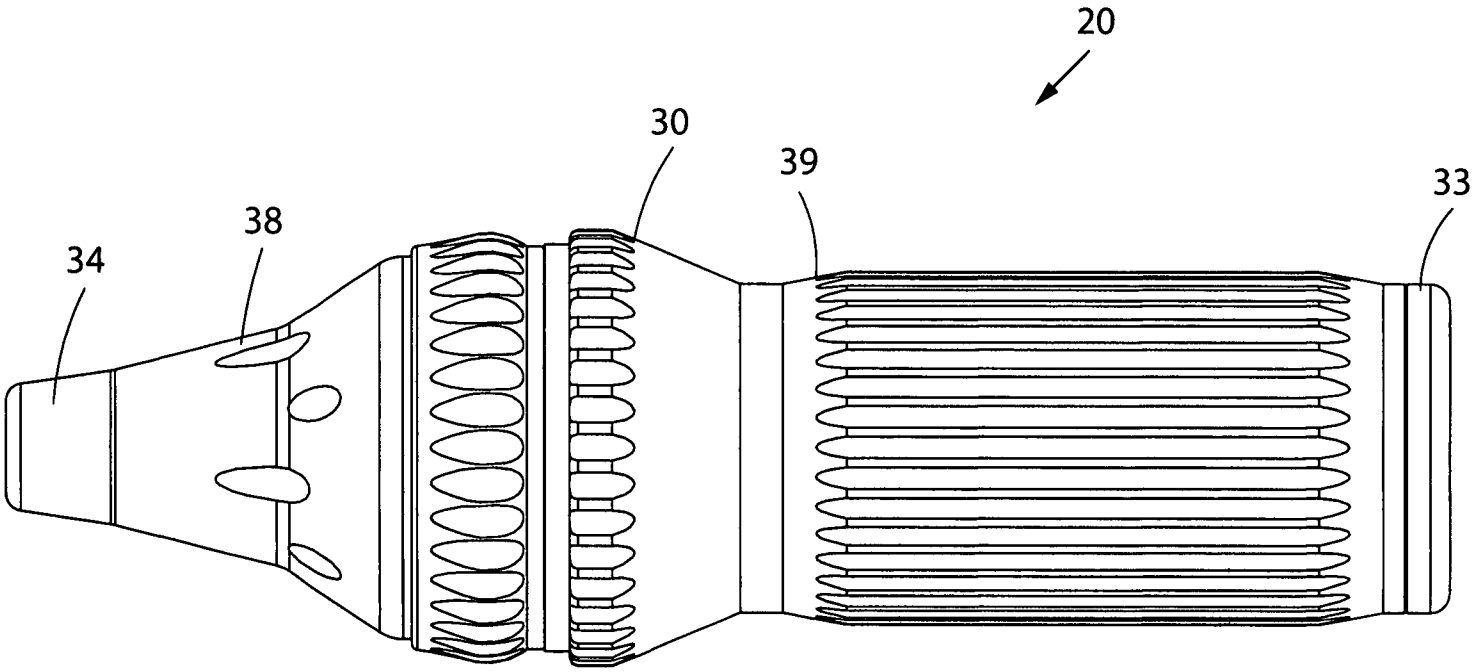
FIG. 3 is a side elevational view of the preferred embodiment of the multi-bit tool of FIG. 1, with the tool bit retracted.
Figure 4:
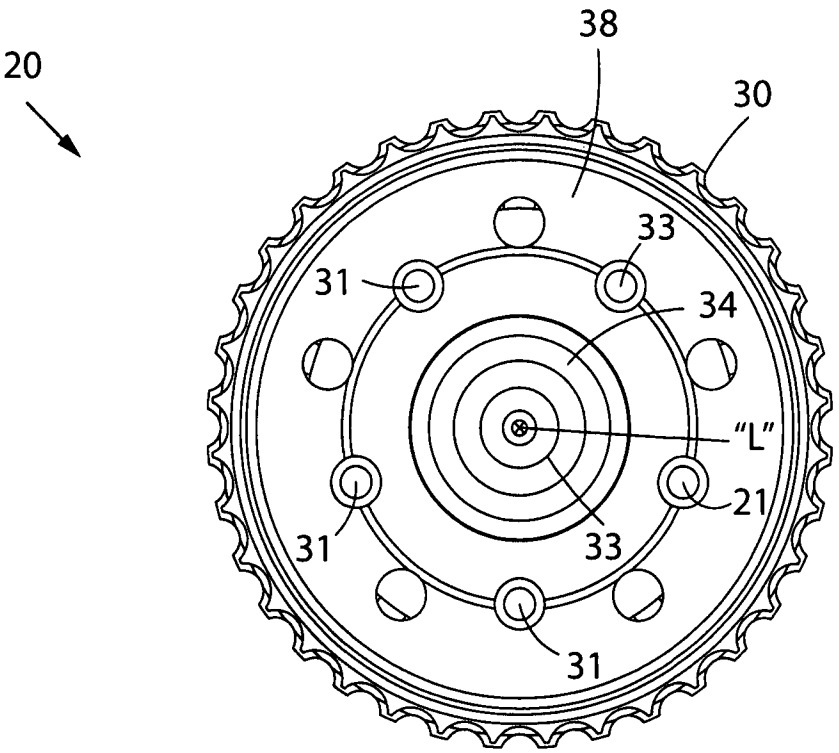
FIG. 4 is a front end elevational view of the preferred embodiment of the multi-bit tool of FIG. 1.
Figure 5:
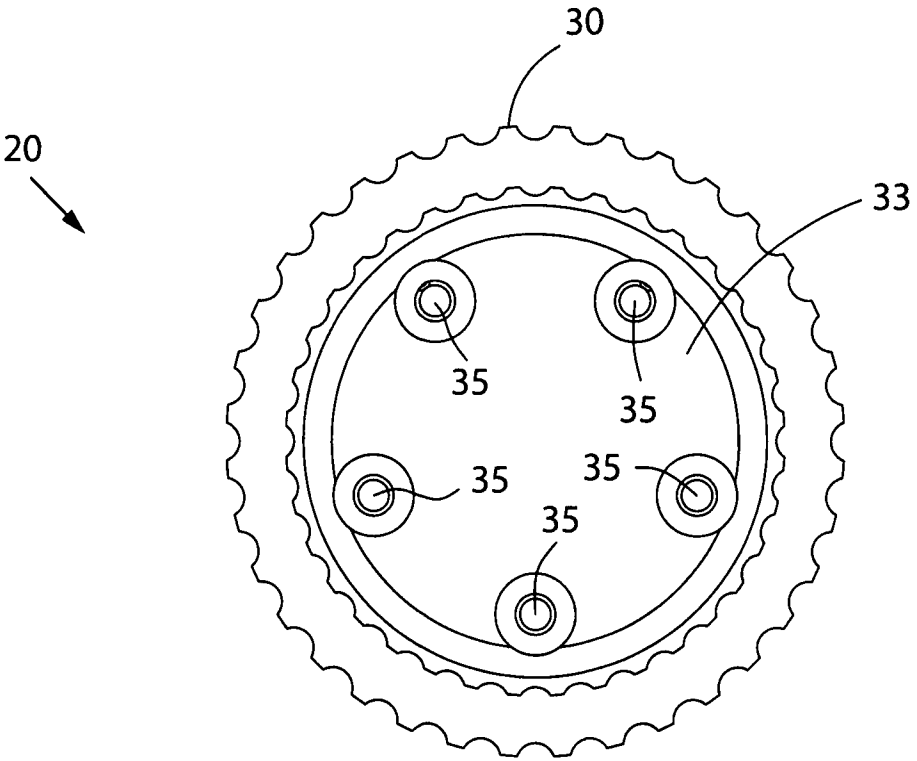
FIG. 5 is a back end elevational view of the preferred embodiment of the multi-bit tool of FIG. 1.
Figure 6:
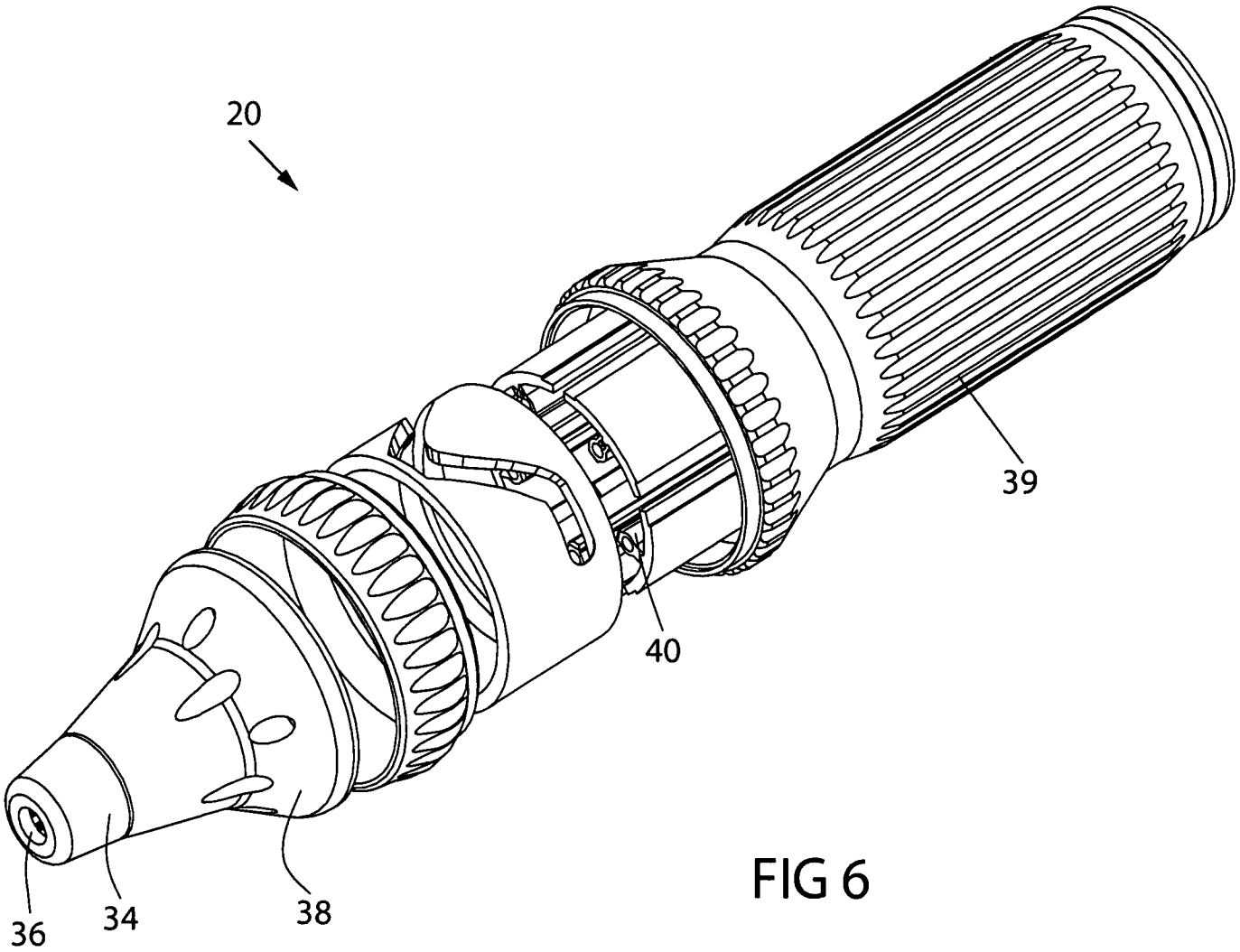
FIG. 6 is an exploded perspective view of the preferred embodiment of the multi-bit tool of FIG. 1.
Figure 7:
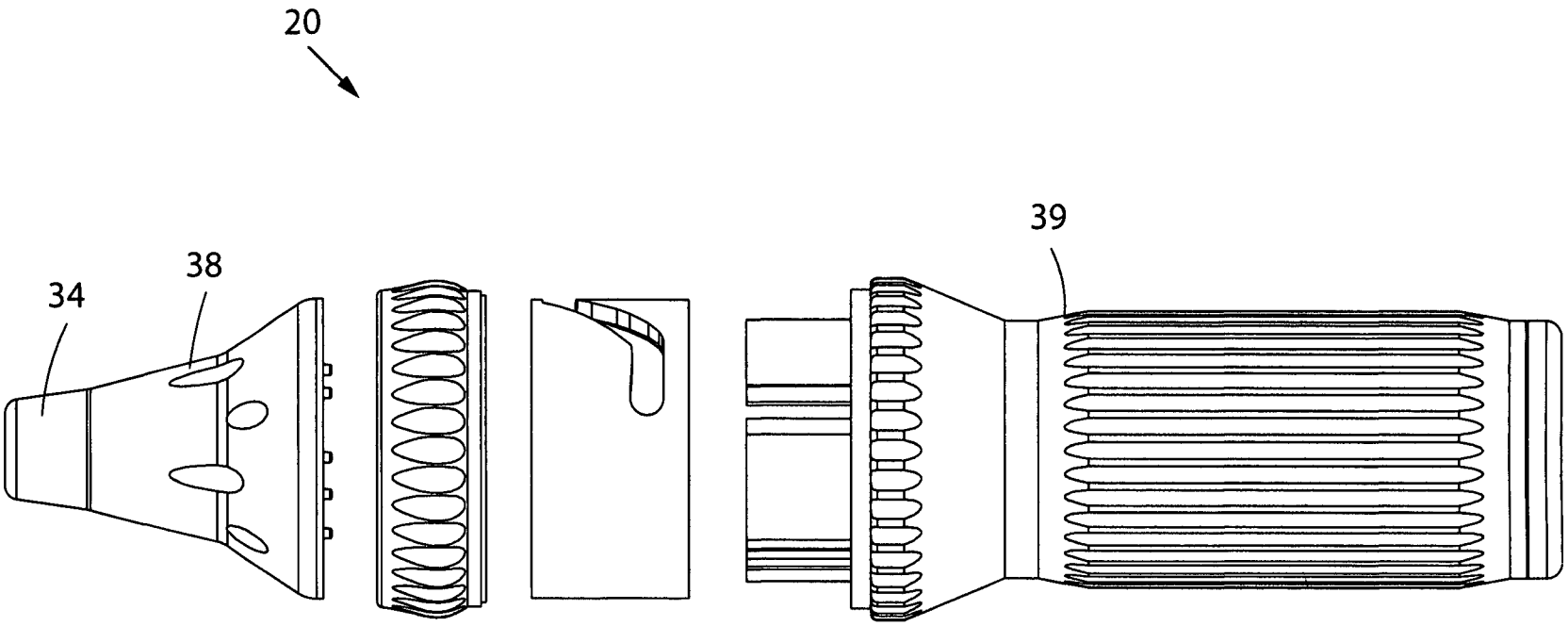
FIG. 7 is an exploded side elevational view of the preferred embodiment of the multi-bit tool of FIG. 1.
Figure 8:
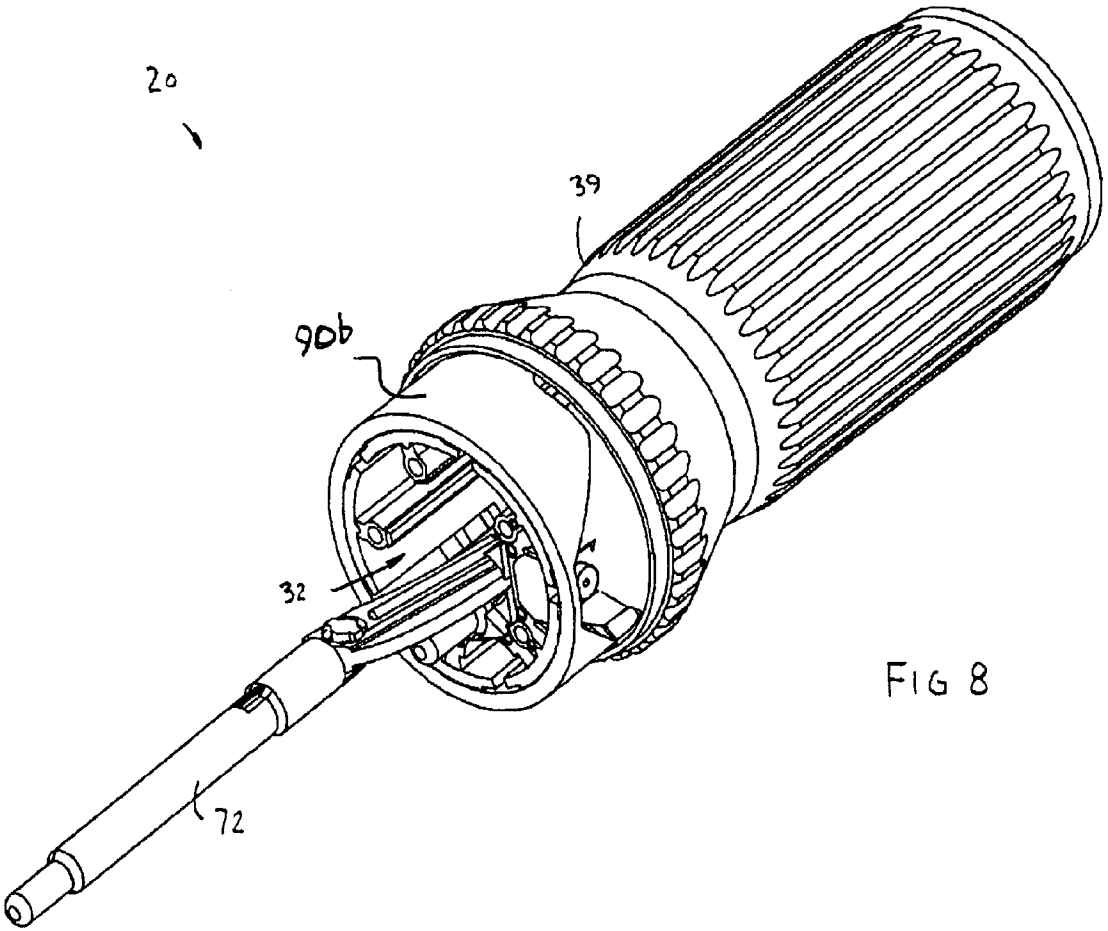
FIG. 8 is an exploded perspective view of the preferred embodiment of the multi-bit tool of FIG. 1, with the front cone and a ridged collar not shown for the sake of clarity.

Reference will now be made to FIGS. 1 through 27, which show a preferred embodiment of the multi-bit tool of the present invention, as indicated by general reference numeral 20. In brief, the preferred embodiment multi-bit tool 20 comprises a housing 30, a substantially rigid main frame member 40, spring loaded actuator mechanisms 60, a plurality of bit assemblies 70, and an annular collar member 90.

The preferred embodiment multi-bit tool 20 comprises a substantially annular housing 30 having a central interior cavity 32 and a bit chuck 34 with a bit-receiving opening 36. The substantially annular housing 30 defines a central longitudinal axis "L". The housing 30 acts as the handle for the multi-bit tool 20, and may be of any suitable shape. As can be seen in the figures, the substantially annular housing 30 comprises a forward cone portion 38 and a central handle portion 39 secured one to the other in selectively separable relation by means of suitable threaded fasteners 31 for the sake of manufacturing convenience and to permit subsequent access to the central interior cavity 32 of the substantially annular housing 30.

The central handle portion 39 has a plurality of radially arcuate plates 37*p* disposed at the front end thereof. In the preferred embodiment as illustrated, there are five arcuate plates 37*p*, with each arcuate plate 37*p* separated from the two adjacent arcuate plates 37*p* by a pin receiving slot 37*s*, the purpose of which will be discussed in greater detail subsequently.

The substantially annular housing 30 also has an end cap 33 secured to the back end of the substantially annular housing 30 by means of suitable threaded fasteners 35 for the sake of manufacturing convenience and to permit subsequent access to the central interior cavity 32 of the substantially annular housing 30.

There is a substantially rigid main frame member 40 that has a front end 42 and a back end 44. In the preferred embodiment, as illustrated, the substantially annular housing 30 and the substantially rigid main frame member 40 are each separate and distinct pieces. The housing 30 and the substantially rigid main frame member 40 are structurally interconnected one to the other such that the substantially rigid main frame member 40 precludes significant torsional deformation of the housing 30.

The substantially rigid main frame member 40 is retained within the interior cavity 32 of the housing 30 to be generally aligned along the longitudinal axis "L".

The substantially rigid main frame member 40 defines a plurality of longitudinal channels 41, as can readily be seen in the figures. The substantially rigid main frame member 40 is disposed within the housing 30 such that each of the plurality of longitudinal channels 41 is generally aligned along the longitudinal axis "L". The substantially rigid main frame member comprises a plurality of actuator separators 43 extending outwardly from the longitudinal axis "L". The plurality of actuator separators 43 preferably extend radially outwardly from the longitudinal axis "L".

The substantially rigid main frame member 40 further comprises a central core 46 and wherein the plurality of actuator separators 43 extend radially outwardly from the central core 46. The plurality of actuator separators 43 define a maximum height outwardly from the central core 46.

Each the actuator separator 43 comprises a proximal wall portion 48 connected to the central core 46 and a distal wall portion 50 connected to the proximal wall portion 48. Each the proximal wall portion 48 terminates prior to the distal wall portion 50 forwardly along the longitudinal axis "L", thereby defining an open space 52 immediately forward of the proximal wall portion 48. Each proximal wall portion 48 of the substantially rigid main frame member 40 also connects to the forward cone portion 38 of the substantially annular housing 30.

The central core 46 extends forwardly along the longitudinal axis "L" past the front of the proximal wall portions 48. Preferably, the central core 46 is tapered at its front end 47 to accommodate the passage of the tool bits 72 therepast.

The ratio of the maximum height "H" of the plurality of actuator separators 43 to the outside diameter "D" of the central core 46 of the substantially rigid main frame member 40 is greater than 1.5:1. This permits the proper accommodation of the plurality of spring loaded actuator mechanisms 60 within the central interior cavity 32 of the substantially annular housing 30. Also in order to properly accommodate the plurality of spring loaded actuator mechanisms 60 within the central interior cavity 32 of the substantially annular housing 30, the proximal wall portion 48 comprises, in cross-section, a reduced waist portion 54.

Preferably, for the purpose of maximum rigidity and minimum overall size and thickness, the substantially rigid main frame member 40 is made from metal. Any other suitable material or combination of materials could be used.

There is also a plurality of spring loaded actuator mechanisms 60 disposed within the interior cavity 32 of the housing 30. The plurality of spring loaded actuator mechanisms 60 are carried in rigidly retained relation by the substantially rigid main frame member 40 within the interior cavity 32 of said housing 30. Each spring loaded actuator mechanism 60 is mounted in rigidly retained relation within one channel 41 of the substantially rigid main frame member 40. The plurality of spring loaded actuator mechanisms 60 are mounted within the substantially rigid main frame member 40 such that contact of each spring loaded actuator mechanism 60 with the other spring loaded actuator mechanisms 60 is precluded.

Preferably, but not necessarily, the spring loaded actuator mechanisms 60 comprise sub-assemblies containing one or more springs and other components and the like. Alternatively, the spring loaded actuator mechanisms comprise assembled individual components within the housing 30 and supported by the housing 30 and/or the substantially rigid main frame member 40.

Cartridge type spring loaded actuator mechanisms 60 are well known and can be found in various prior art patent documents such as U.S. Pat. No. 2,854,745, the teachings of which are incorporated herein by reference.

Figures 9, 10:
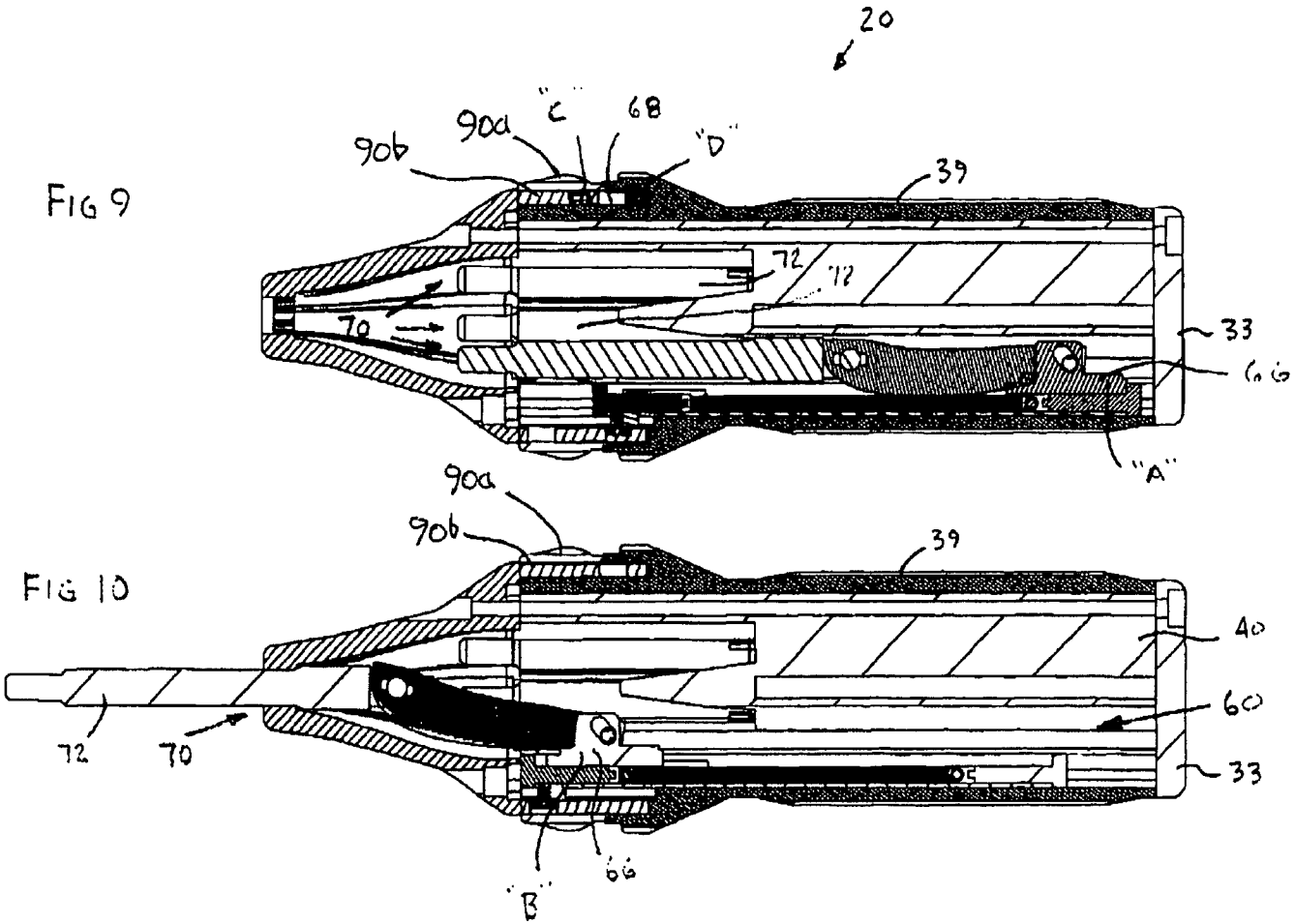
FIG. 9 is a sectional side elevational view of the preferred embodiment of the multi-bit tool of FIG. 1, with the tool bit retracted.
FIG. 10 is a sectional side elevational view of the preferred embodiment of the multi-bit tool of FIG. 1, with the tool bit extended.
Figure 11:
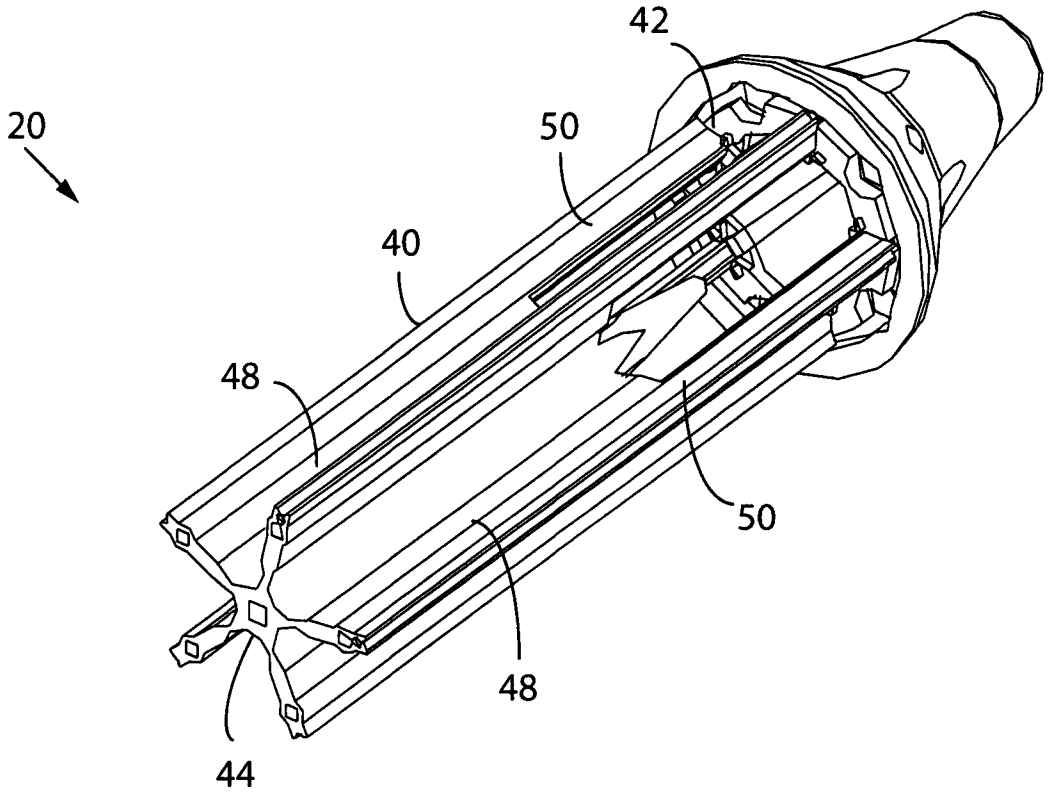
FIG. 11 is a perspective view from the back of the substantially rigid main frame member and the bit chuck used in the preferred embodiment of the multi-bit tool of FIG. 1.
Figure 12:
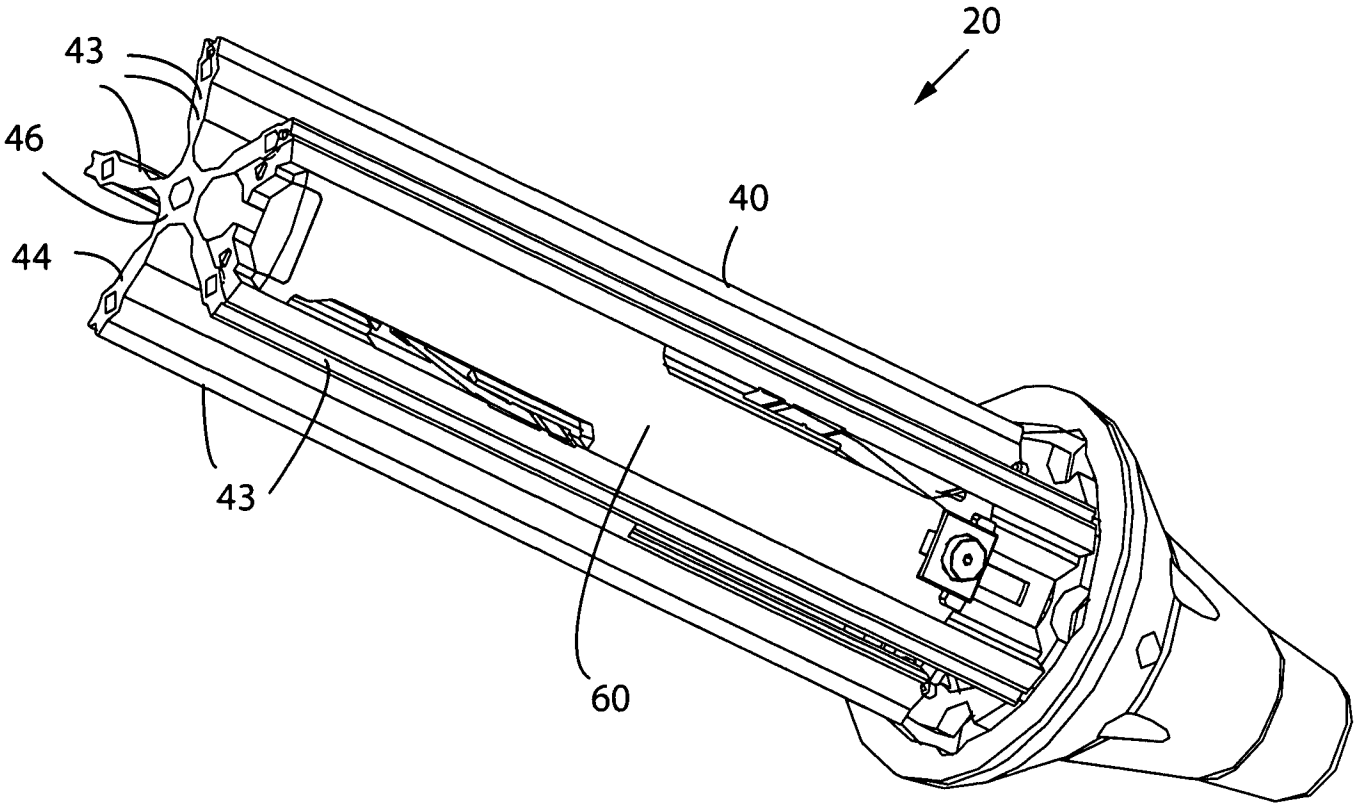
FIG. 12 is a perspective view from the back of the substantially rigid main frame member and the bit chuck used in the preferred embodiment of the multi-bit tool of FIG. 1.
Figure 13:
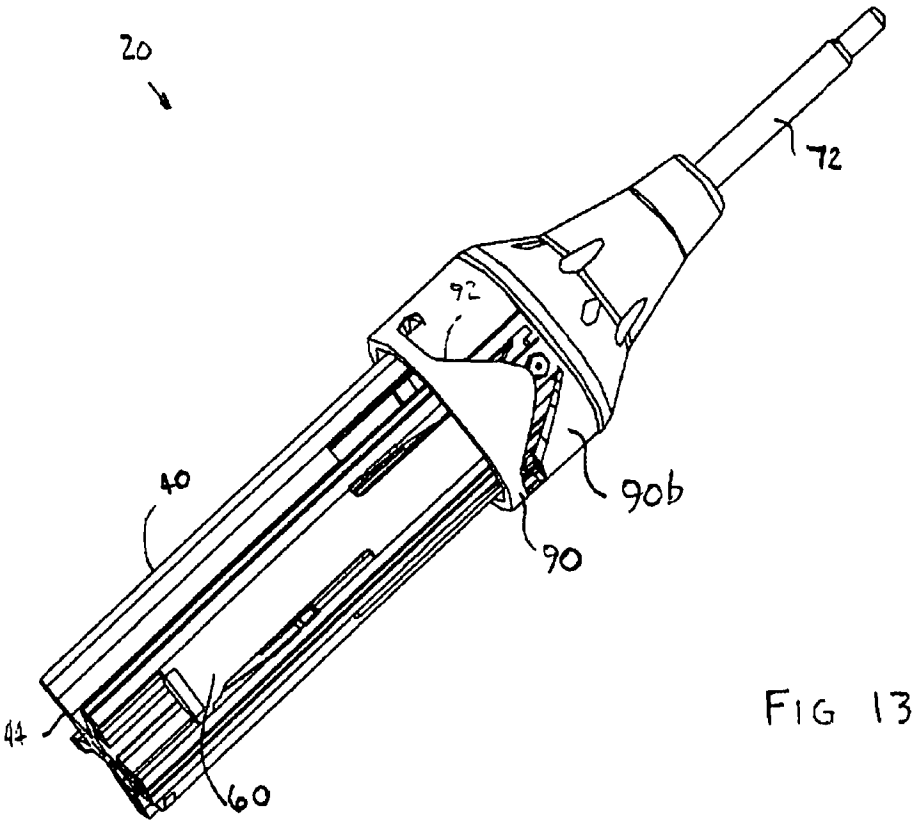
FIG. 13 is a perspective view from the back of the substantially rigid main frame member, the bit chuck and the actuation collar used in the preferred embodiment of the multi-bit tool of FIG. 1.

Each spring loaded actuator mechanism 60 has a carriage member 66 that is movable between a rearward position, as indicated by reference letter "A" in FIG. 9, and a forward position, as indicated by reference letter "B" in FIG. 10, and a trigger member 68 movable between a rest position, a forward triggering position, as is indicated by reference letter "C" in FIG. 9, and a rearward triggering position, as is indicated by reference letter "D" in FIG. 9. The carriage member 66 is moved to its rearward position by movement of the trigger member 68 to its rearward triggering position and the carriage member 66 is moved to its forward position by movement of the trigger member 68 to its forward triggering position. Each trigger member 68 comprises a cam follower portion 68*p* that engages a co-operating cam surface 92 on the annular collar member 90. Further, each trigger member 68 is mounted for longitudinal sliding movement over a short distance, within the associated spring loaded actuator mechanism 60.

Figure 14:
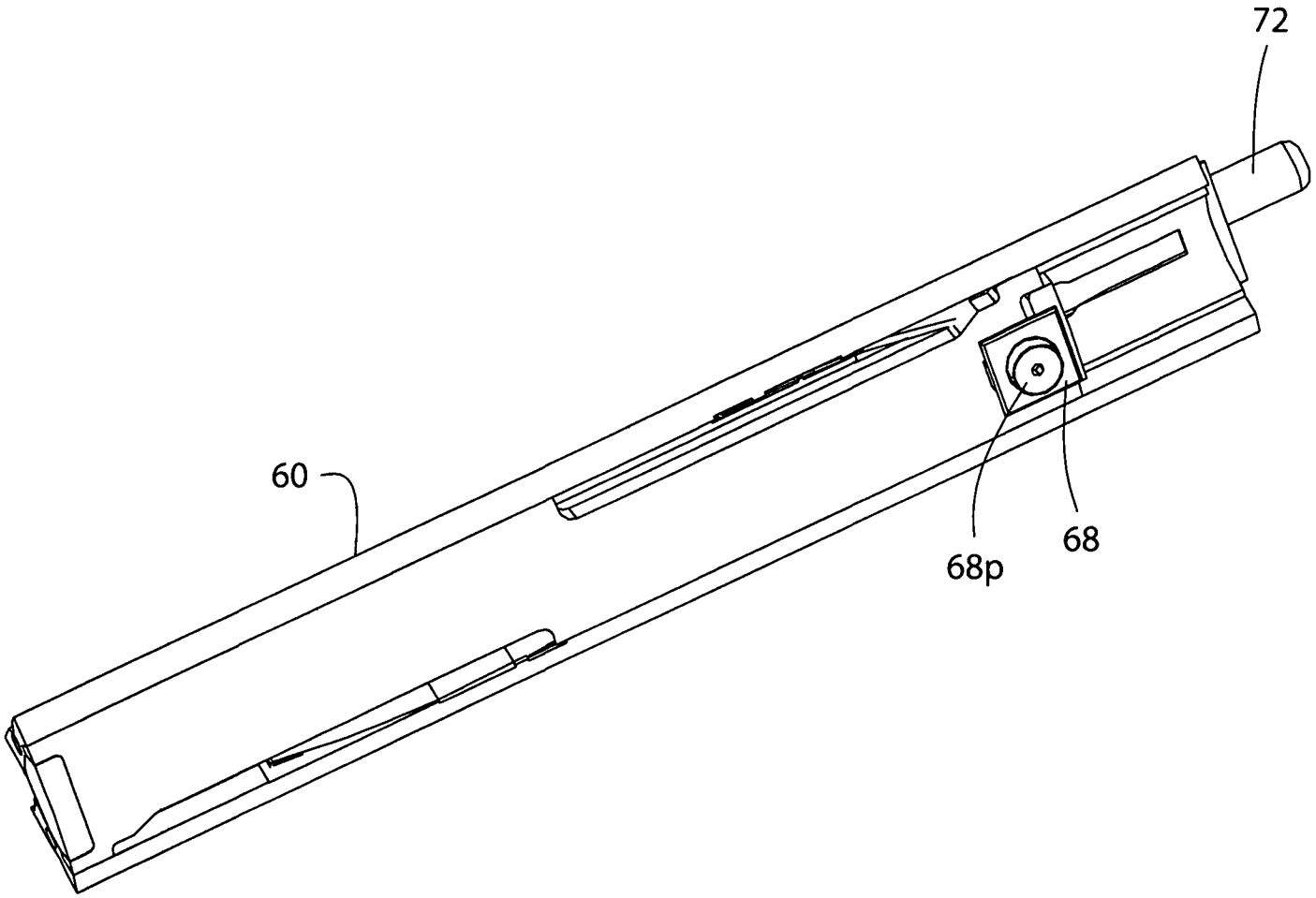
FIG. 14 is a perspective view of one of the cartridges used in the preferred embodiment of the multi-bit tool of FIG. 1, with the carriage member and the bit assembly in a retracted configuration.
Figure 15:
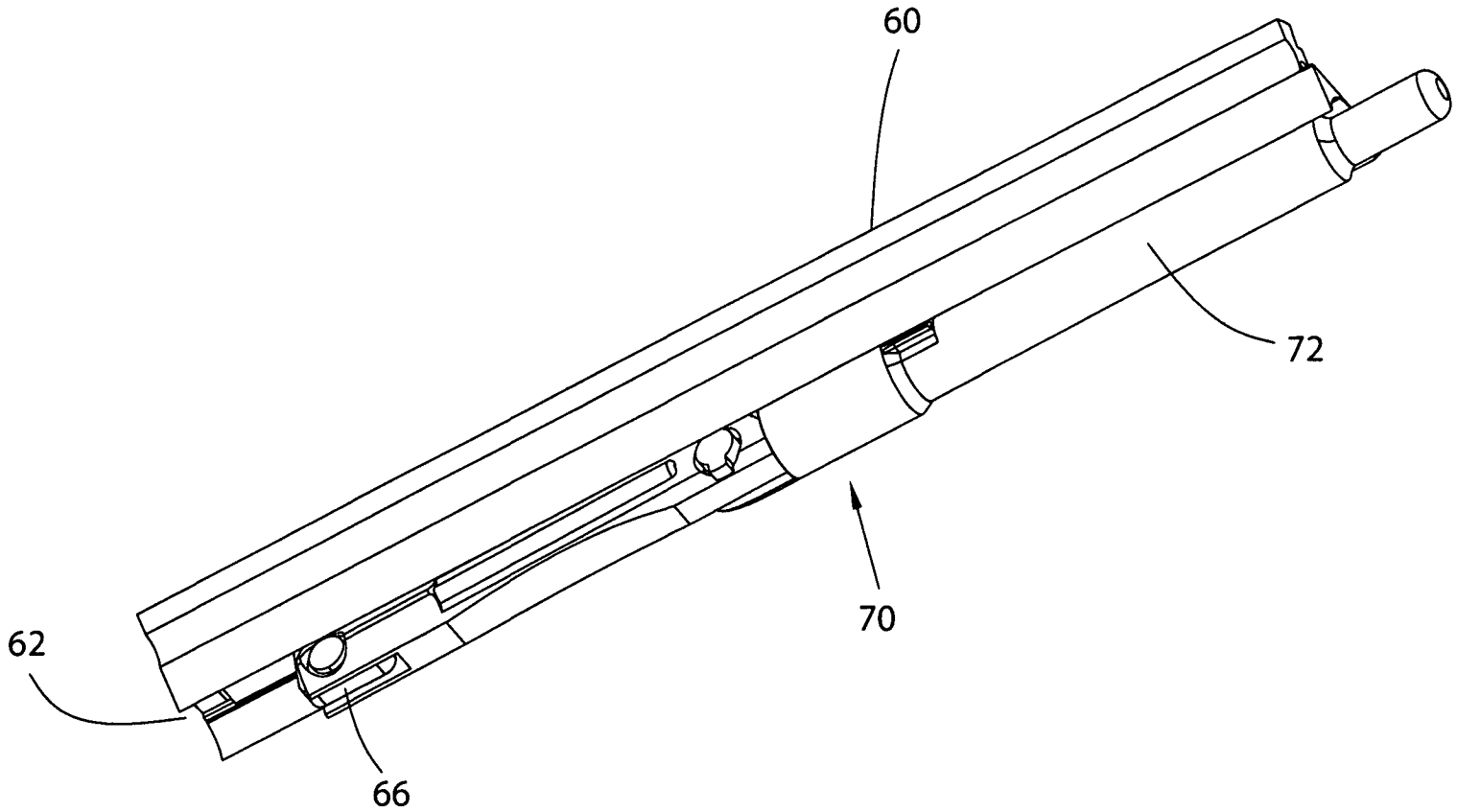
FIG. 15 is another perspective view of one of the cartridges used in the preferred embodiment of the multi-bit tool of FIG. 1, with the carriage member and the bit assembly in a retracted configuration.
Figure 16:
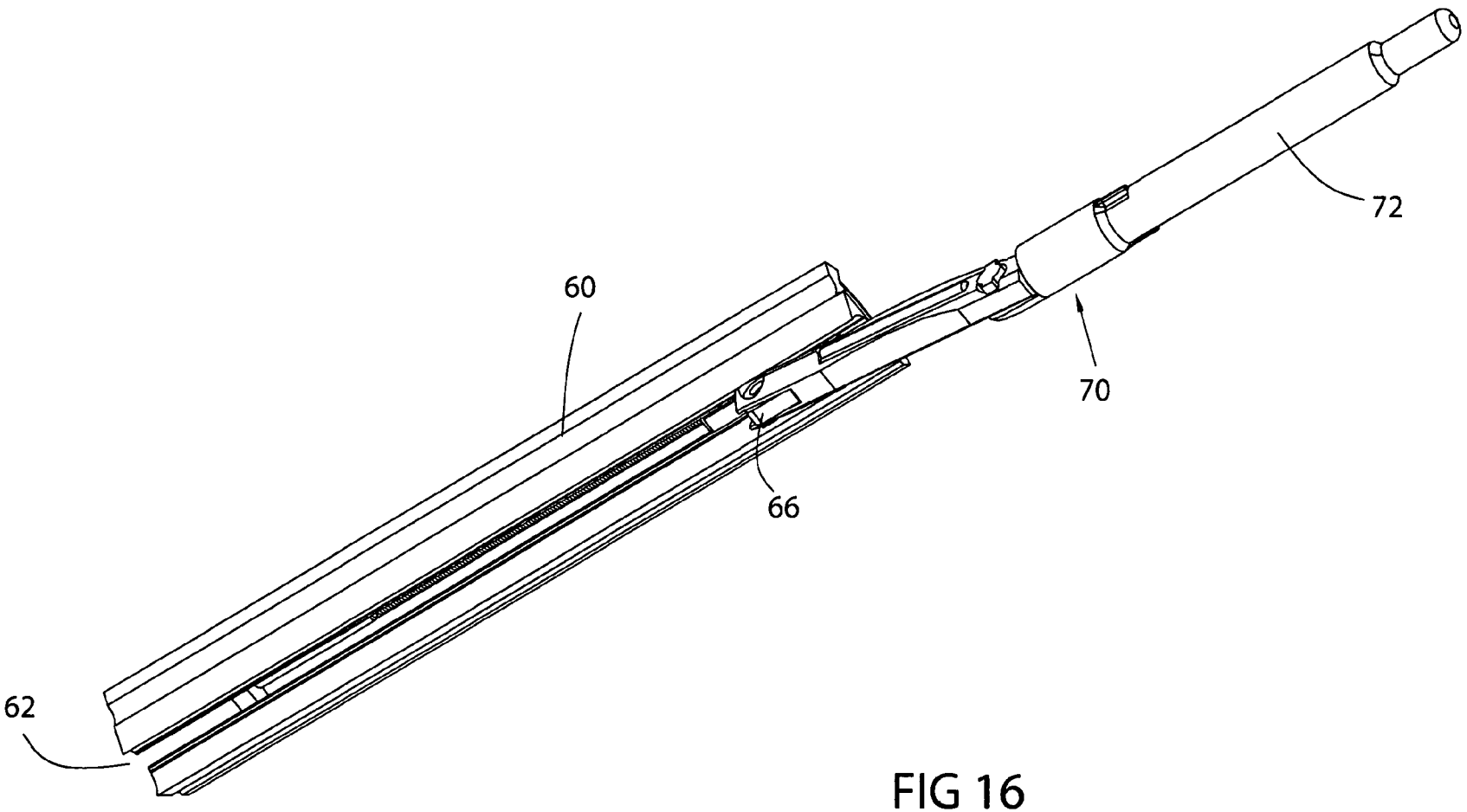
FIG. 16 is another perspective view of one of the cartridges used in the preferred embodiment of the multi-bit tool of FIG. 1, with the carriage member and the bit assembly in an extended in-use configuration.
Figures 17, 18, 19, 20, 21:
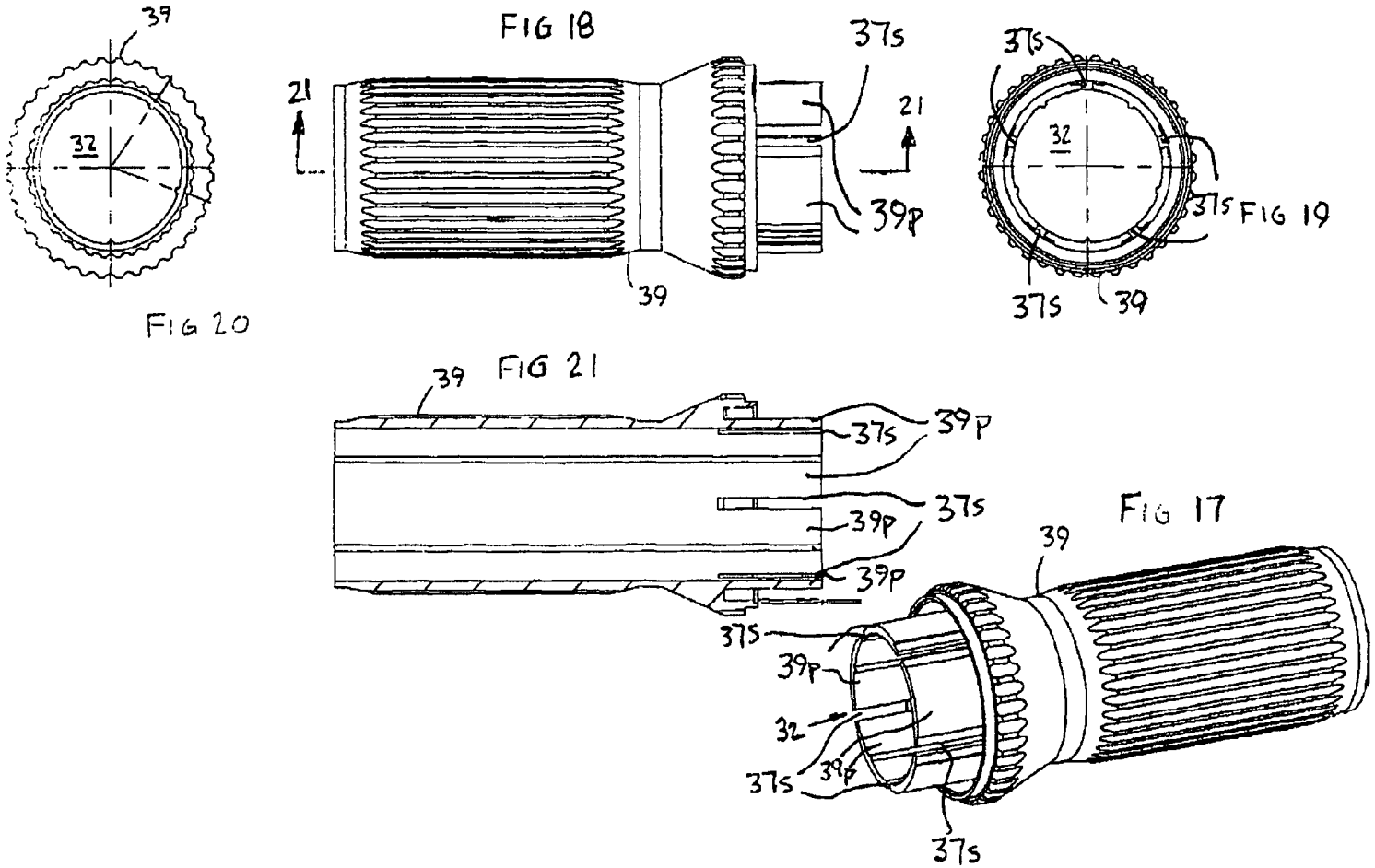
FIG. 17 is a perspective view of the substantially annular housing used in the preferred embodiment of the multi-bit tool of FIG. 1.
FIG. 18 is a side elevational view of the substantially annular housing used in the preferred embodiment of the multi-bit tool of FIG. 1.
FIG. 19 is a front elevational view of the substantially annular housing used in the preferred embodiment of the multi-bit tool of FIG. 1.
FIG. 20 is a back elevational view of the substantially annular housing used in the preferred embodiment of the multi-bit tool of FIG. 1.
FIG. 21 is a sectional side elevational view of the substantially annular housing used in the preferred embodiment of the multi-bit tool of FIG. 1, taken along section line 21-21 of FIG. 18.
Figures 22, 23, 24, 25, 26:
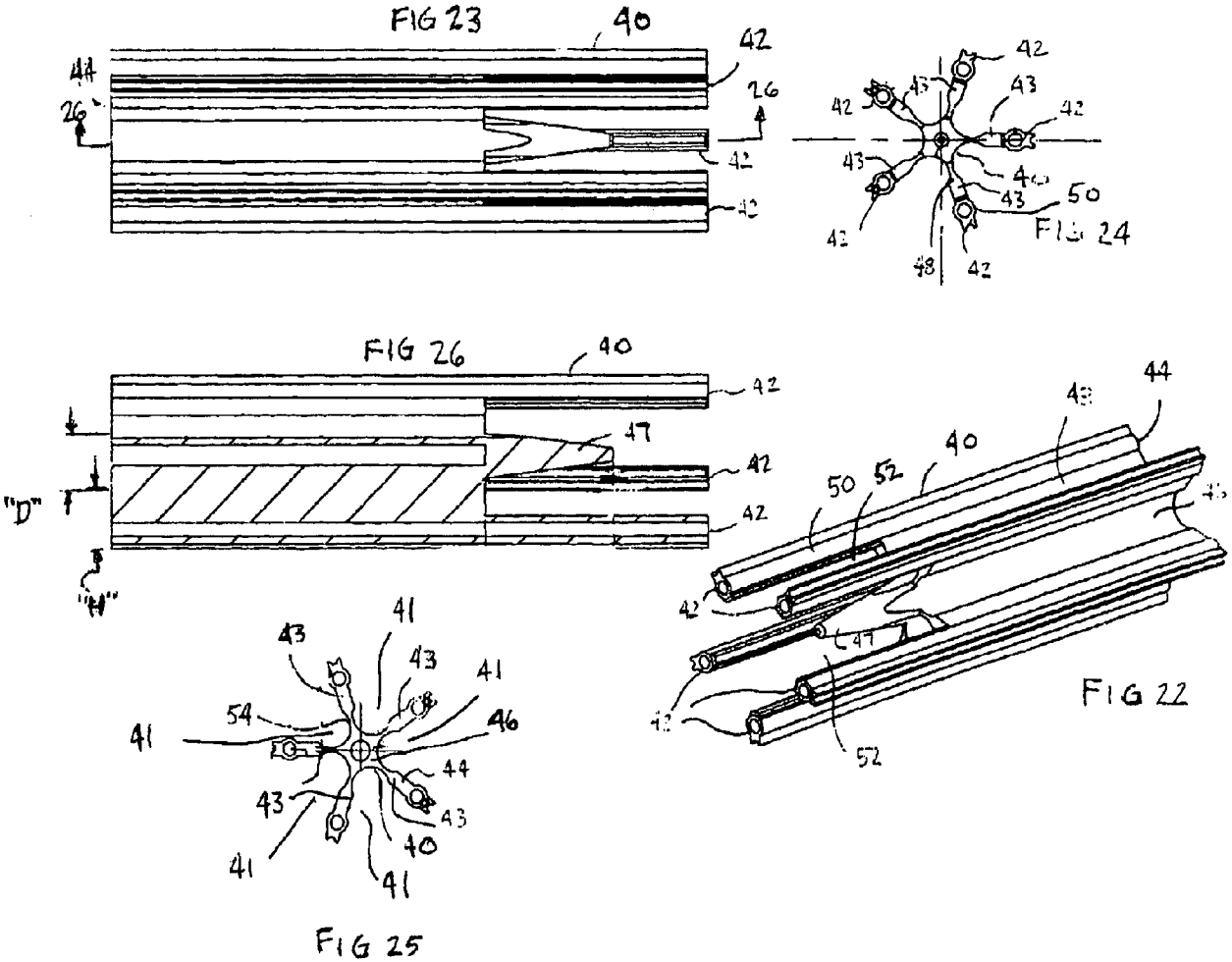
FIG. 22 is a perspective view of the substantially rigid main frame member used in the preferred embodiment of the multi-bit tool of FIG. 1.
FIG. 23 is a side elevational view of the substantially rigid main frame member used in the preferred embodiment of the multi-bit tool of FIG. 1.
FIG. 24 is a front elevational view of the substantially rigid main frame member used in the preferred embodiment of the multi-bit tool of FIG. 1.
FIG. 25 is a back elevational view of the substantially rigid main frame member used in the preferred embodiment of the multi-bit tool of FIG. 1.
FIG. 26 is a sectional side elevational view of the substantially rigid main frame member used in the preferred embodiment of the multi-bit tool of FIG. 1, taken along section line 26-26 of FIG. 23; and, FIG. 27 is a perspective view from the front of the outer housing and the substantially rigid main frame member used in the preferred embodiment of the multi-bit tool of FIG. 1.
Figure 27:
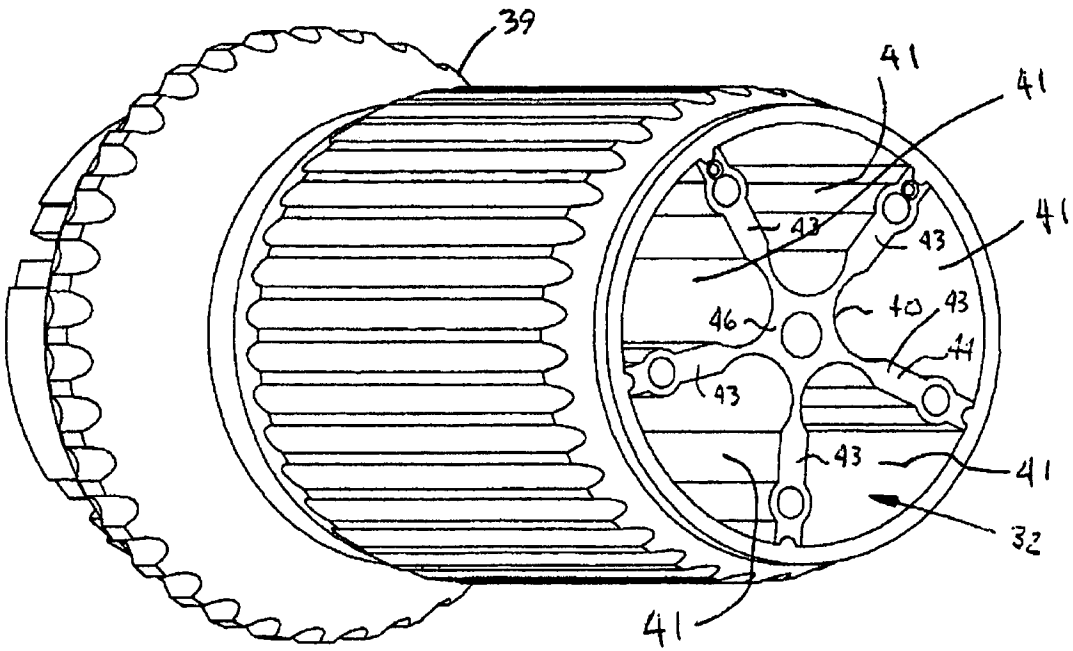

As can be best seen in FIGS. 14 through 16, the spring loaded actuator mechanisms 60 are substantially straight along their length. Each spring loaded actuator mechanism 60 has an elongate substantially straight slot 62 therein. As the carriage member 66 travels along its spring loaded actuator mechanism 60, a portion of the carriage member 66 rides along the elongate slot 62 in the spring loaded actuator mechanism 60.

The multi-bit tool 20 also comprises a plurality of bit assemblies 70 within the substantially annular housing 30. Each bit assembly 70 has a tool bit 72 at a front end and is operatively mounted within the housing 30 for movement by the actuator mechanism 60 between a retracted configuration corresponding to the rearward position of the carriage member 66, and a forwardly extended in-use configuration corresponding to the forward position of the carriage member 66. In the forwardly extended in-use configuration, the bit assembly 70 is positioned such that the tool bit 72 extends outwardly from the housing 30 through the opening 36 of the bit chuck 34.

Preferably, each the tool bit 72 is substantially cylindrically shaped, in order to accommodate the passage of bits 72 past the tapered front end 47 of the central core 46.

Each bit assembly is operatively connected to the carriage member 66 on a corresponding spring loaded mechanism 80 for co-operative movement therewith. In use, as each carriage member 66 moves between its rearward position and its forward position, the corresponding spring loaded actuator mechanism 60 is retained substantially in its correct form by the substantially rigid main frame member 40.

The multi-bit tool 20 further comprises an annular collar member 90 mounted in rotatable relation on the housing 30. The annular collar member 90 comprises a ridged outer ring 90*a* and an internal cam ring 90*b* that are secured one to the other for co-rotation around the housing 30. More specifically, the internal cam ring 90*b* fits over the five arcuate plates 37*p* in reasonably close fitting but freely rotatable relation. The internal cam ring 90*b* has a cam surface 92 that engages the trigger members 68 of the spring loaded actuator mechanisms 60 as the annular collar member 90 is rotated around the housing 30 about the longitudinal axis "L", to thereby movable the trigger members 68 between their rest positions, their forward triggering positions and their rearward triggering positions.

In use, as each carriage member 66 moves between its rearward position and its forward position, the corresponding spring loaded actuator mechanism 40 is retained substantially in its correct form, or in other words its original shape, by the substantially rigid main frame member 40. In this manner, the cartridge type spring loaded actuator mechanisms 60 are within and are supported by a stable body to ensure that there is no twisting of the cartridge type spring loaded actuator mechanisms 60 that would otherwise distort the path of the slot 62 in the actuator mechanisms 60. Accordingly, the ready and consistent operation of the cartridge type spring loaded actuator mechanisms 60 is readily achieved.

In another aspect of the present invention, it is contemplated that in one the embodiment of the present invention, the present invention comprises a multi-implement apparatus that could be a toy that functions in an analogous manner to the multi-bit tool 20 as described.

As can be understood the accompanying drawings, the present invention provides a multi-bit tool having spring loaded actuation mechanisms, wherein the jamming of the tool bit assemblies and the spring loaded actuation mechanisms is significantly reduced, and perhaps almost eliminated, and which multi-bit tool is more ergonomic and therefore easier to use than prior art multi-bit tools, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the multi-bit tool of the present invention without departing from the spirit and scope of the accompanying claims.

I claim:

1. A multi-bit tool comprising:

a substantially annular housing having a central interior cavity and a bit chuck with a bit-receiving opening, and defining a longitudinal axis;

a substantially rigid main frame member having a front end and a back end, wherein said housing and said substantially rigid main frame member are structurally interconnected one to the other such that said substantially rigid main frame member precludes significant torsional deformation of said housing;

a plurality of spring loaded actuator mechanisms disposed within the interior cavity of said housing;

wherein each said spring loaded actuator mechanism has a carriage member movable between a rearward position and a forward position, and a trigger member movable between a rest position, a forward triggering position and a rearward triggering position, and wherein said carriage member is moved to its rearward position by movement of said trigger member to its rearward triggering position and said carriage member is moved to its forward position by movement of said trigger member to its forward triggering position; and, a plurality of bit assemblies, wherein each bit assembly has a tool bit at a front end and is operatively mounted within said housing for movement by said actuator mechanism between a retracted configuration corresponding to the rearward position of the carriage member, and a forwardly extended in-use configuration corresponding to the forward position of the carriage member and whereat said bit assembly is positioned such that said tool bit extends outwardly from said housing through said opening of said bit chuck;

wherein each bit assembly is operatively connected to the carriage member on a corresponding spring loaded mechanism for co-operative movement therewith; and, wherein, in use, as each carriage member moves between its rearward position and its forward position, the corresponding spring loaded actuator mechanism is retained substantially in its correct form by said substantially rigid main frame member. wherein said substantially rigid main frame member has a front end and a back end wherein said substantially rigid main frame member comprises a plurality of actuator separators extending outwardly from said longitudinal axis;

wherein said plurality of actuator separators extend radially outwardly from said longitudinal axis;

wherein said substantially rigid main frame member further comprises a central core and wherein said plurality of actuator separators extend radially outwardly from said central core;

wherein each said actuator separator comprises a proximal wall portion connected to said central core and a distal wall portion connected to said proximal wall portion;

wherein each said proximal wall portion terminates prior to said distal wall portion forwardly along said longitudinal axis, thereby defining an open space immediately forward of said proximal wall portion.

2. The multi-bit tool of claim 1, wherein said plurality of spring loaded actuator mechanisms are carried in rigidly retained relation by said substantially rigid main frame member within the interior cavity of said housing.

3. The multi-bit tool of claim 2, wherein said substantially rigid main frame member is retained within the interior cavity of said housing.

4. The multi-bit tool of claim 3, wherein said substantially rigid main frame member is disposed within said housing to be generally aligned along said longitudinal axis.

5. The multi-bit tool of claim 4, wherein said substantially rigid main frame member defines a plurality of longitudinal channels.

6. The multi-bit tool of claim 5, wherein each spring loaded actuator mechanism is mounted in rigidly retained relation within one channel of said substantially rigid main frame member.

7. The multi-bit tool of claim 6, wherein said substantially rigid main frame member is disposed within said housing such that each of said plurality of longitudinal channels is generally aligned along said longitudinal axis.

8. The multi-bit tool of claim 1, wherein said plurality of spring loaded actuator mechanisms are mounted within said substantially rigid main frame member such that contact of each spring loaded actuator mechanism with the other spring loaded actuator mechanisms is precluded.

9. The multi-bit tool of claim 1, wherein the spring loaded actuator mechanisms comprise cartridges.

10. The multi-bit tool of claim 9, wherein said spring loaded actuator mechanisms are substantially straight.

11. The multi-bit tool of claim 10, wherein each said spring loaded actuator mechanism has an elongate slot therein, and wherein said carriage member travels along said slot in said spring loaded actuator mechanism.

12. The multi-bit tool of claim 11, wherein said slot is substantially straight.

13. The multi-bit tool of claim 1, wherein said plurality of actuator separators define a maximum height outwardly from said central core.

14. The multi-bit tool of claim 13, wherein the ratio of said maximum height of said plurality of actuator separators to the outside diameter of said central core of said substantially rigid main frame member is greater than 1.5:1.

15. The multi-bit tool of claim 1, wherein said substantially annular housing comprises a forward cone portion and a central handle portion secured one to the other.

16. The multi-bit tool of claim 15, wherein said forward cone portion and said central handle portion are secured one to the other in selectively separable relation.

17. The multi-bit tool of claim 16, wherein each said proximal wall portion terminates prior to said distal wall portion forwardly along said longitudinal axis, thereby defining an open space immediately forward of said proximal wall portion.

18. The multi-bit tool of claim 17, wherein said central core extends forwardly along said longitudinal axis past the front of said proximal wall portions.

19. The multi-bit tool of claim 18, wherein said central core is tapered at its front end.

20. The multi-bit tool of claim 15, wherein each said proximal wall portion of said substantially rigid main frame member connect to said forward cone portion of said substantially annular housing.

21. The multi-bit tool of claim 1, wherein said substantially rigid main frame member is made from metal.

22. The multi-bit tool of claim 1, further comprising an annular collar member mounted in rotatable relation on said housing, and having a cam surface that engages the trigger members of said spring loaded actuator mechanisms as said annular collar member is rotated around said housing about said longitudinal axis, to thereby movable said trigger members between their rest positions, their forward triggering positions and their rearward triggering positions.

23. The multi-bit tool of claim 1, wherein each said tool bit is substantially cylindrically shaped.

24. The multi-bit tool of claim 1, wherein said substantially annular housing and said substantially rigid main frame member are each separate and distinct pieces.

25. The multi-bit tool of claim 1, wherein said proximal wall portion comprises, in cross-section, a reduced waist portion.

* * * * *